United States Patent [19]

Homer

[11] 4,063,650

[45] Dec. 20, 1977

[54] EQUIPMENT HANDLING SYSTEM

[75] Inventor: Joseph F. Homer, Houston, Tex.

[73] Assignee: Exxon Production Research Company, Houston, Tex.

[21] Appl. No.: 654,676

[22] Filed: Feb. 2, 1976

[51] Int. Cl.[2] ..... B65G 47/90

[52] U.S. Cl. ..... 214/1 BB; 105/29 R; 187/19; 214/1 R

[58] Field of Search ..... 254/95; 105/29 R; 214/1 R, 1 P, 2.5, 1 BB, 16.4 A, 95 R; 187/9 R, 9 E, 19; 74/422

[56] References Cited

U.S. PATENT DOCUMENTS

| | | | |
|---|---|---|---|
| 2,395,411 | 2/1946 | Kittel | 254/95 X |
| 2,573,575 | 10/1951 | Keroson | 187/19 X |
| 3,232,455 | 2/1966 | Fountain et al. | 187/19 X |
| 3,412,876 | 11/1968 | Calabrese | 214/15 R |
| 3,782,565 | 1/1974 | Doran et al. | 214/16.4 A |
| 3,817,412 | 6/1974 | Mercier et al. | 214/2.5 X |

*Primary Examiner*—Frank E. Werner
*Attorney, Agent, or Firm*—John S. Schneider

[57] ABSTRACT

A transporter system for handling heavy equipment, such as subsea blowout preventer stacks, on floating type drilling vessels. The transporter system includes rack and pinion mechanisms to move the transporter apparatus up and down and fore and aft on the drilling vessel.

13 Claims, 10 Drawing Figures

RACK
48b
59b
LIFT LUG
57b
49b
GUIDE
61b
48b
RACK
61b
50b
28b
28

48b
RACK
47b
8
59b
59b
58b
LIFT LUG
58b
8
60b
7
7
46b
28
28b 63b
62b
44b
45b
40b
41b
43b
MOTOR
42b
POWER
CABLE
52b
56b
26
SPIDER
BEAM
REEL
55b
33b
51b
33b
53b
53b
54b
STABILIZER
ROLLERS
54b

EQUIPMENT HANDLING SYSTEM

BACKGROUND OF THE INVENTION

This invention concerns transporter apparatus for use on floating type drilling vessels and, particularly, transporter apparatus capable of moving heavy equipment up and down and fore and aft on the drilling vessel. More particularly, the invention concerns transporter apparatus for handling heavy blowout preventer (BOP) stacks on floating drilling vessels which is capable of moving a BOP stack into position over the well bay on the drilling vessel preparatory to lowering the BOP stack to the well located on the sea floor and of moving the BOP stack to and placing it on a test stump for repair maintenance and testing, and to provide a storage frame for the BOP stack during movements of the vessel from one location to another.

Heretofore, heavy equipment such as blowout preventer stacks were generally moved fore and aft on floating drilling vessels by bridge-type overhead cranes which suspended the blowout preventer stack from rails. Those overhead cranes had undesirable features which the present invention overcomes. For example, bridge cranes usually could not lift the entire stack necessitating partial dismantling of the stack; and wire lines used to support the stack permitted adverse motion due to pitch and roll of the vessel. The transporter system of this invention holds the stack rigidly with reference to the vessel.

SUMMARY OF THE INVENTION

An equipment handling system for moving equipment on floating drilling vessels on which two parallel beams or tracks are mounted. The tracks are located on each side of the spider deck opening and extend from underneath the drilling derrick substructure to a point beyond the substructure convenient for maintenance and testing of equipment being handled. The transporter apparatus consists of two individually powered mobile frame sides mounted on wheels which roll on the tracks as the tracking pinion gears are energized. Each frame side has a vertical mounted geared rack to which the equipment being handled is secured. The vertical racks overhang the spider deck opening so that the racks may travel vertically inside the spider deck opening. The racks are confined in a rack guide and are powered with individual motors driving a pinion gear which meshes with the rack gear. Lift lugs for engaging the equipment to be moved are connected to each rack for movement with it. Also, retainer latches are connected to each rack. A geared rack is arranged on each track to permit movement and control of the equipment along the track by means of a motor driven pinion gear mounted on each transporter frame side. Stabilizer rollers are also connected to each frame side for engaging flanges on the underside of each track to stabilize the fore and aft movement of each frame side and resist overturning. A power cable reel is mounted on each side of the frame and a power cable is wound on each reel and connected to a source of power for supplying power to the motor with which it is associated.

DESCRIPTION OF THE PREFERRED EMBODIMENTS

Figure 1:
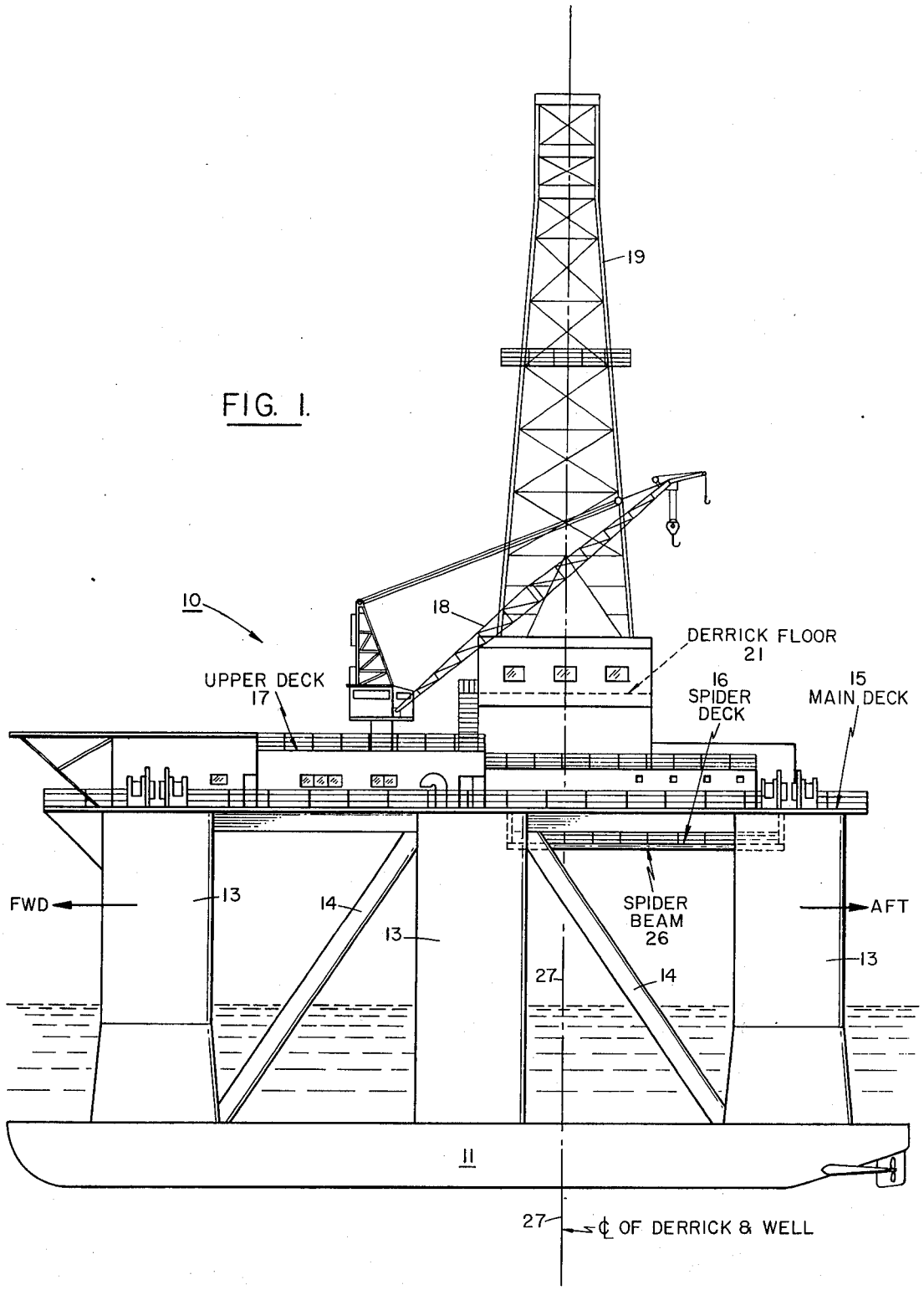
FIG. 1 is a side elevational view of a semisubmersible drilling vessel.
Figure 2:
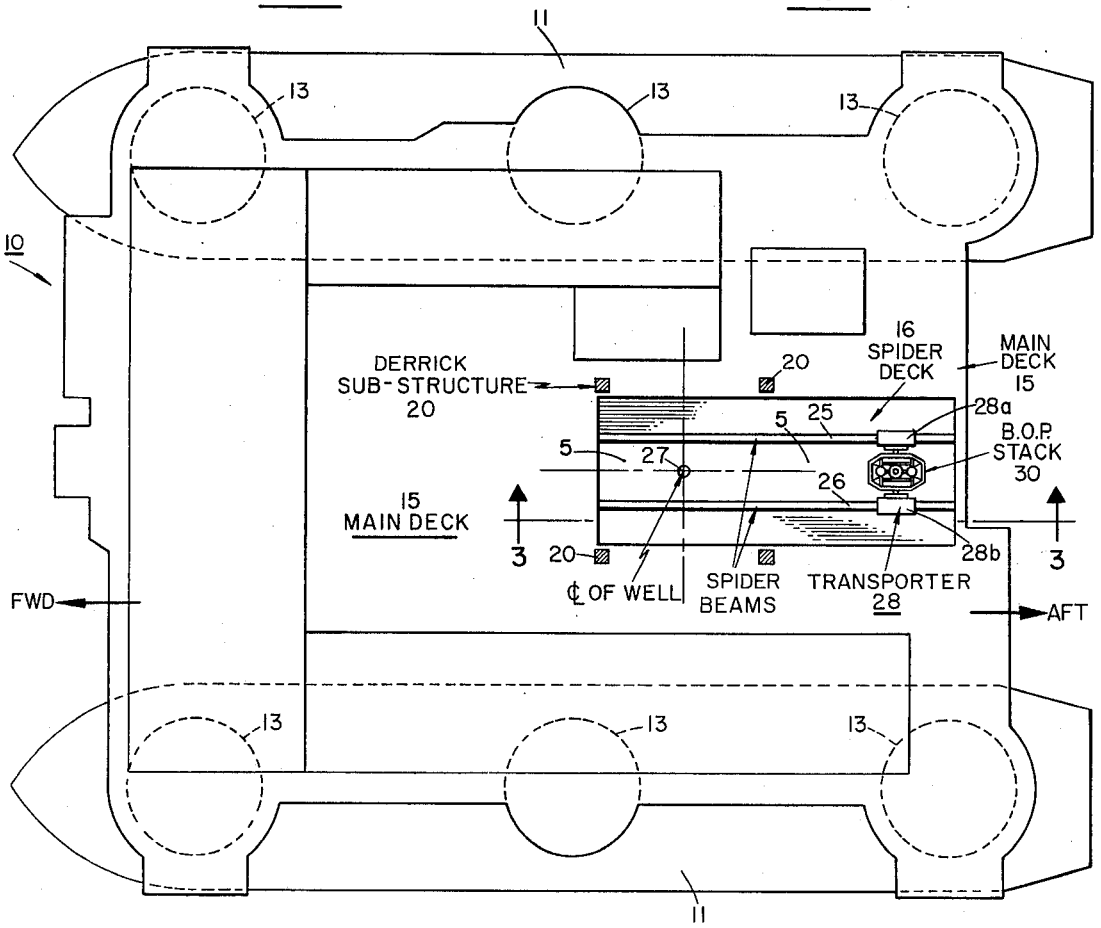
FIG. 2 is a plan view of the drilling vessel shown in FIG. 1 and including the transporter system of the invention positioned on the spider deck.

Referring to the drawings, and particularly FIGS. 1 and 2, there is shown a semisubmersible drilling vessel 10 comprising a pair of spaced apart pontoons or hulls 11 extending in parallel relation. Each pontoon supports a drilling platform, generally designated 12, on three vertical cylindrical caissons 13 and tubular trusses 14. The drilling platform 12 includes a rectangular working main deck 15, a spider deck 16 below the main deck and an upper deck 17. A crane 18 is mounted on the upper deck. A drilling derrick 19 having a substructure 20, including the derrick floor 21, is supported on main deck 15.

Figure 3:
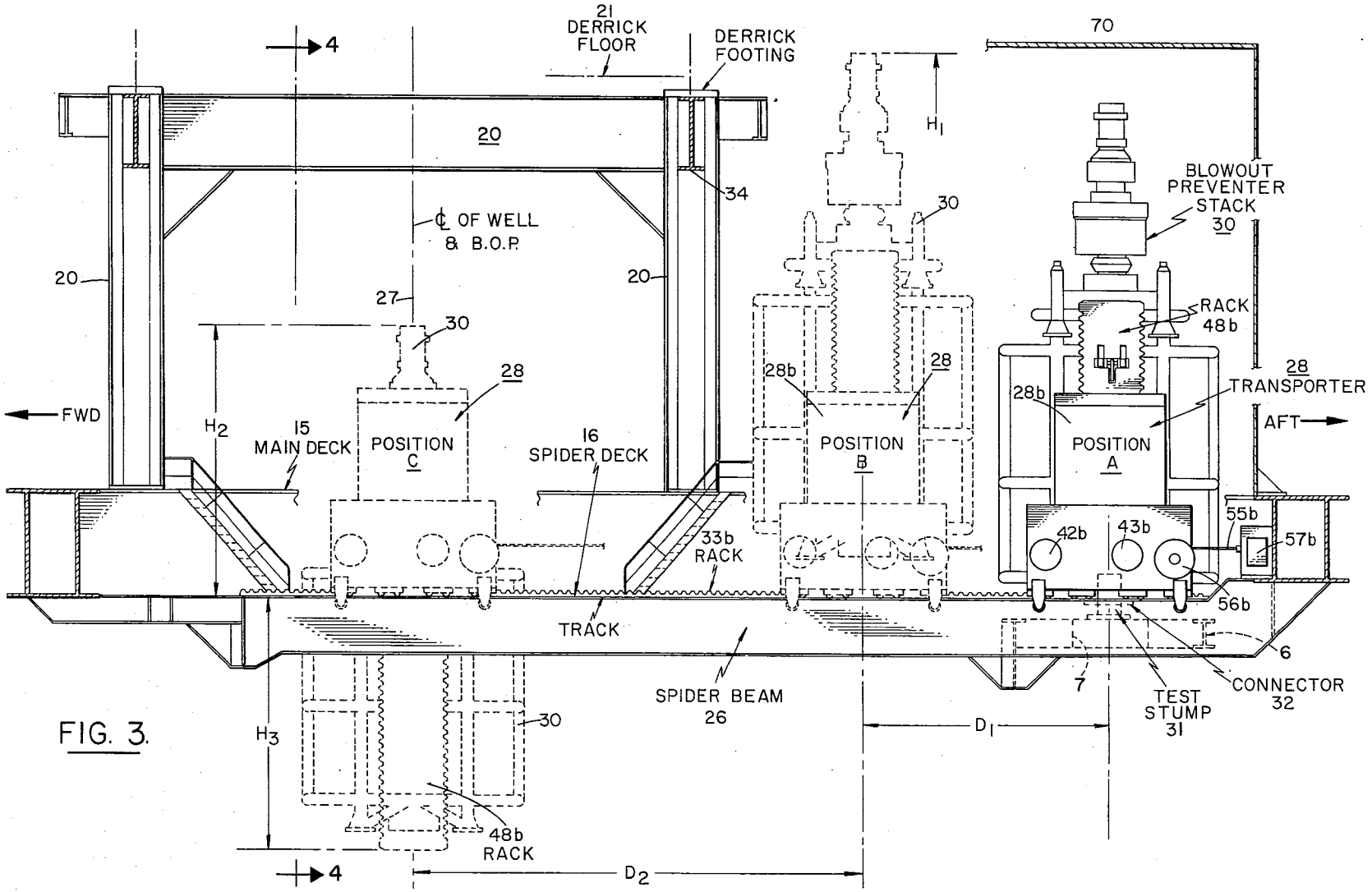
FIG. 3 is a view taken along lines 3—3 of FIG. 2 and illustrating also two other positions of the transporter frame.

In FIG. 3, in which the transporter frame is shown in three positions A, B and C, the spider beams 25 and 26 form tracks which extend fore and aft on each side of the spider deck opening (Moon Pool) 5 in parallel relationship. They extend from underneath substructure 20 to a cross-structure 6 fastened to spider beams 25 and 26 and on which a test stump 31 is supported. Test stump 31 is used for storage, maintenance and testing of equipment being handled. Structure 6 is slotted, as indicated at 7, to allow full vertical movement of the racks in position A. The center line of the subsea well is indicated at 27. One side 28*a* of a transporter frame 28 is positioned on spider beam 25 and the other side 28*b* of frame 28 is positioned on spider beam 26. As will be seen the transporter frame is capable of moving the equipment it supports up and down as well as fore and aft of the drilling vessel. In position A a blowout preventer stack 30 supported on frame 28 has been lowered to test stump 31 and connected to it by connector 32. Position A is the storage position for blowout preventer stack 30. In moving the blowout preventer from position A to a position over the well the blowout preventer stack is first disconnected from stump 31 and raised to a height sufficient to free it therefrom. The frame and BOP stack is then moved to position C, shown in dotted lines, by the frame sides 28*a* and 28*b* driven along racks 33*a* and 33*b* arranged on each of the spider beams 25 and 26. Each transporter frame side is independently movable. When moving frame 28 and supported blowout preventer stack 30 to position C the blowout preventer stack 30 is lowered to clear obstacles such as cross beams 34 which support derrick floor 21. When frame sides 28*a* and 28*b* reach position C the center line of the well and stack 30 is in alignment with the derrick 19. The height of the BOP stack, $H_1$, shown by dotted lines in position B, indicates the uppermost position of blowout preventer 30. This height allows clearance of test stump 31, but also indicates the upper limit of travel with the rack length illustrated. The distance $D_1$ represents the horizontal travel of the frame and BOP stack from position A to position B. The height of the BOP stack, $H_2$, in position C, represents the lowermost position of stack 30 with the rack length illustrated. The distance $D_2$ represents the horizontal travel of the frame and BOP stack from position B to position C.

Figure 4:
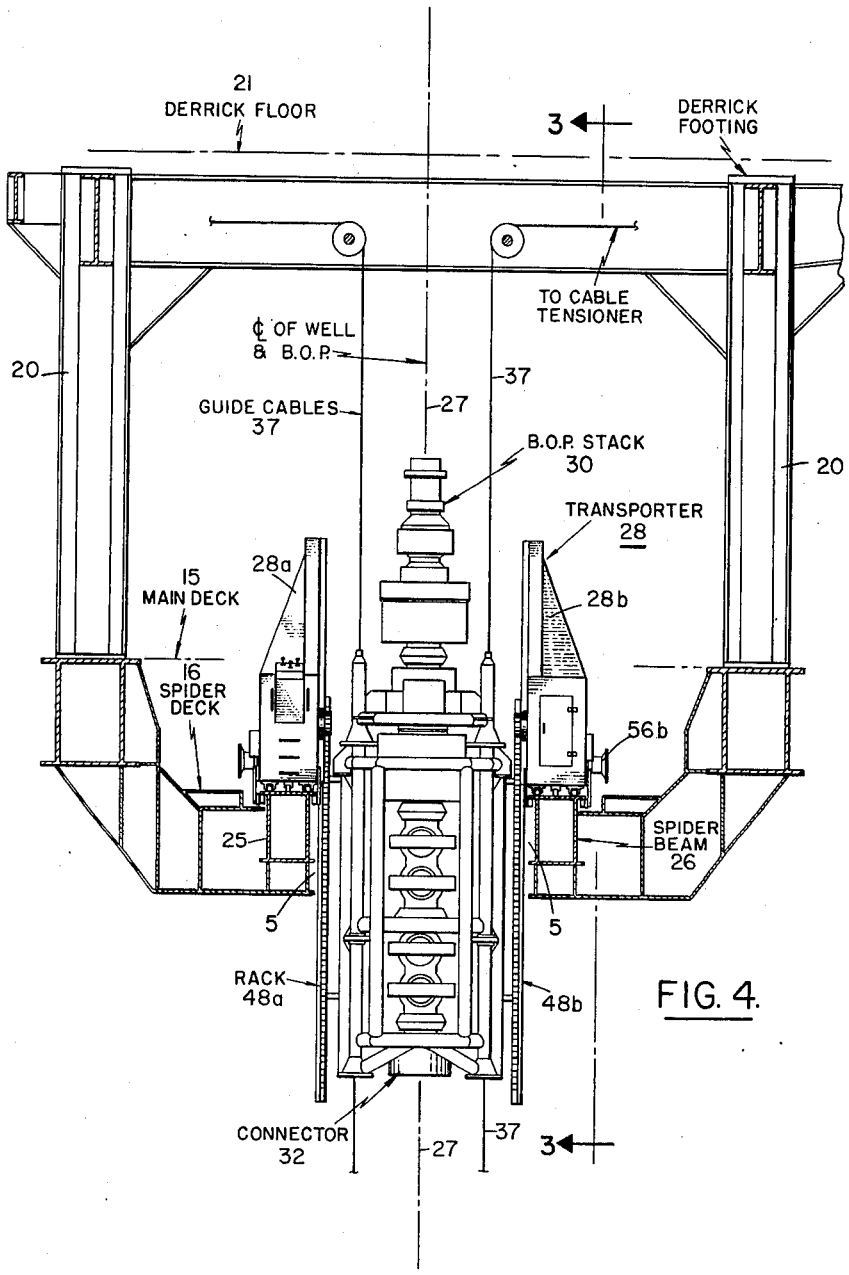
FIG. 4 is a view taken along lines 4—4 of FIG. 3.

FIG. 4 shows the transporter frame and blowout preventer stack in position C in more detail. As shown in that Figure transporter frame sides 28*a* and 28*b* support blowout preventer stack 30.

In this position conventional guide cables 37 (four in number), connected to cable tensioners as indicated, are aligned in the guide tubes of BOP stack 30.

Figures 6, 7, 8:
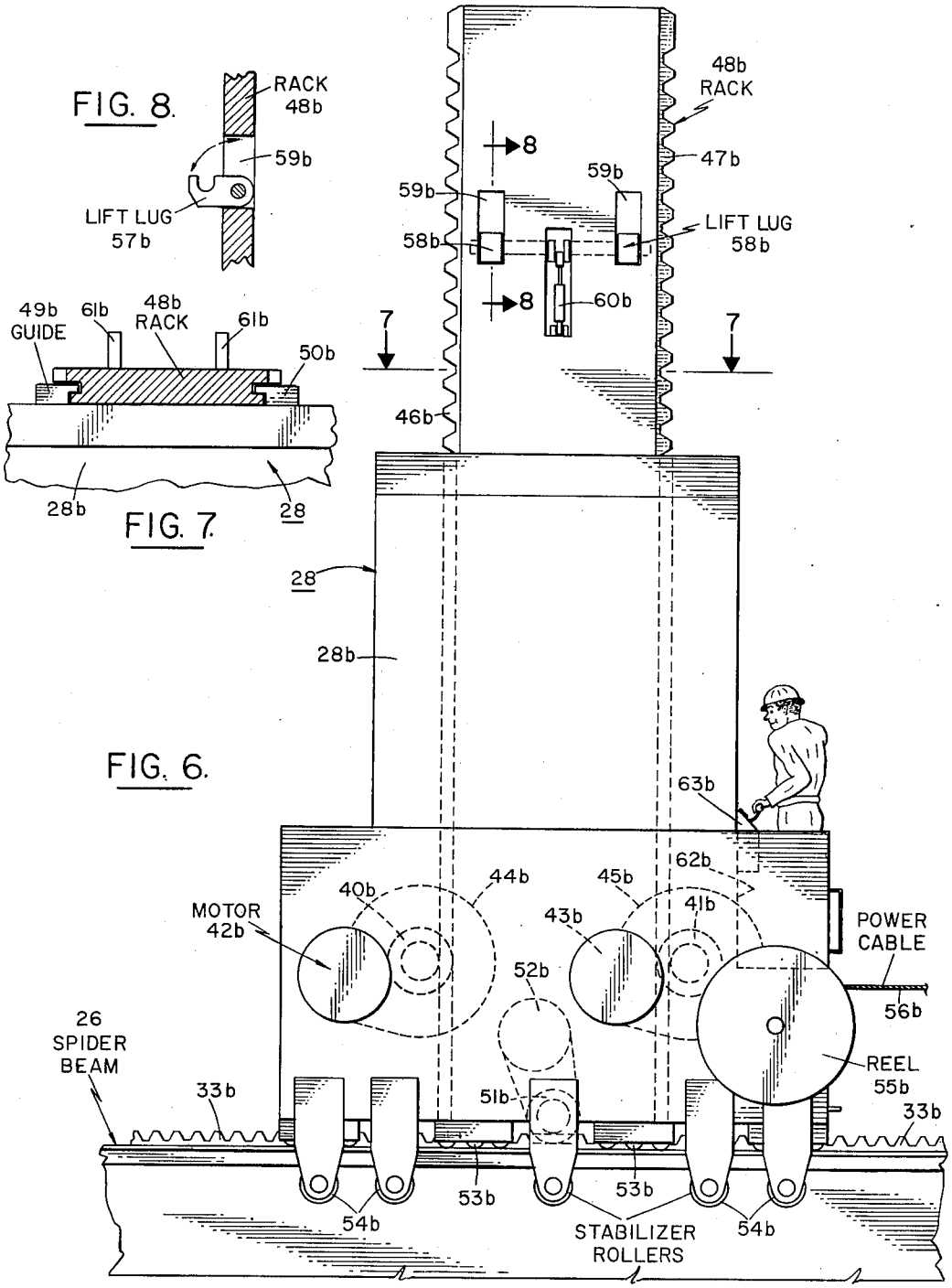
FIG. 6 is a view taken along lines 6—6 of FIG. 5.
FIG. 7 is a view taken along lines 7—7 of FIG. 6.
FIG. 8 is a view taken along lines 8—8 of FIG. 6.

Referring to FIGS. 4 to 8, frame side 28*b* is provided with pinion gears 40*b* and 41*b*, driven by motors 42*b* and 43*b* through drive trains 44*b* and 45*b*. The gears 40*b* and 41*b* engage rack teeth 46*b* and 47*b*, respectively, of a vertical rack 48*b*. The rack is adapted to move vertically in rack guides 49*b* and 50*b* (FIG. 7).

The frame side 28*b* is adapted to be moved horizontally along spider beam 26 by a drive pinion gear 51*b* which is powered by a motor 52*b*. Rollers 53*b*, on frame side 28*b*, engage the top side of spider beam 26 while stabilizer rollers 54*b*, connected to frame side 28*b*, engage the underside of the top flange of spider beam 26.

A power cable 55*b*, having one end thereof wound on a spring reel 56*b* and its other end connected to a power junction box 57*b*, supplies power to operate the motors. Retractable-extendible lift lugs 58*b* mounted on pivot pins in slots 59*b* of rack 48*b* extend, as shown in FIGS. 6 and 8, to engage a portion of blowout preventer 30 to support the blowout preventer on the rack. The lugs are extended and retracted by means of a piston and cylinder assembly 60*b*.

The rack 48*b* is also provided with retainer latches 61*b* which are adapted to engage each side of a lower portion of BOP stack 30 and are operated in a manner similar to the operation of lugs 58*b* (not shown). Latches 61*b* prevent undesirable movement of the lower end of BOP stack 30 and steady it during vertical or horizontal movement during operation of the frame 28. An operator's recess 62*b* is provided on frame 28*b* with a control panel 63*b* by which an operator can control operation of the various motors and gears to move the frame sides 28*a* and 28*b* horizontally on spider beams 25 and 26 and move the racks 48*a* and 48*b* vertically.

Frame side 28*a* is provided with components identical to the aforementioned components on frame side 28*b*. The numbers of the corresponding components are provided with the suffix *a*. Thus, it is seen that frame side 28*a* is provided with an operators recess 62*a* and control panel 63*a*. A power cable similar to 55*b* is wound on a spring reel 56*a* and is connected to a junction box similar to 57*b*. The controls of the panels 63*b* and 63*a* may be synchronized, by means not shown, whereby a single operator, in either of the operators recesses, may operate both frame sides in unison or an operator may be positioned on both frame sides.

Vertical racks 48*a* and 48*b* overhang spider deck opening 5 to permit the racks to move vertically inside that opening.

OPERATION

Figure 5:
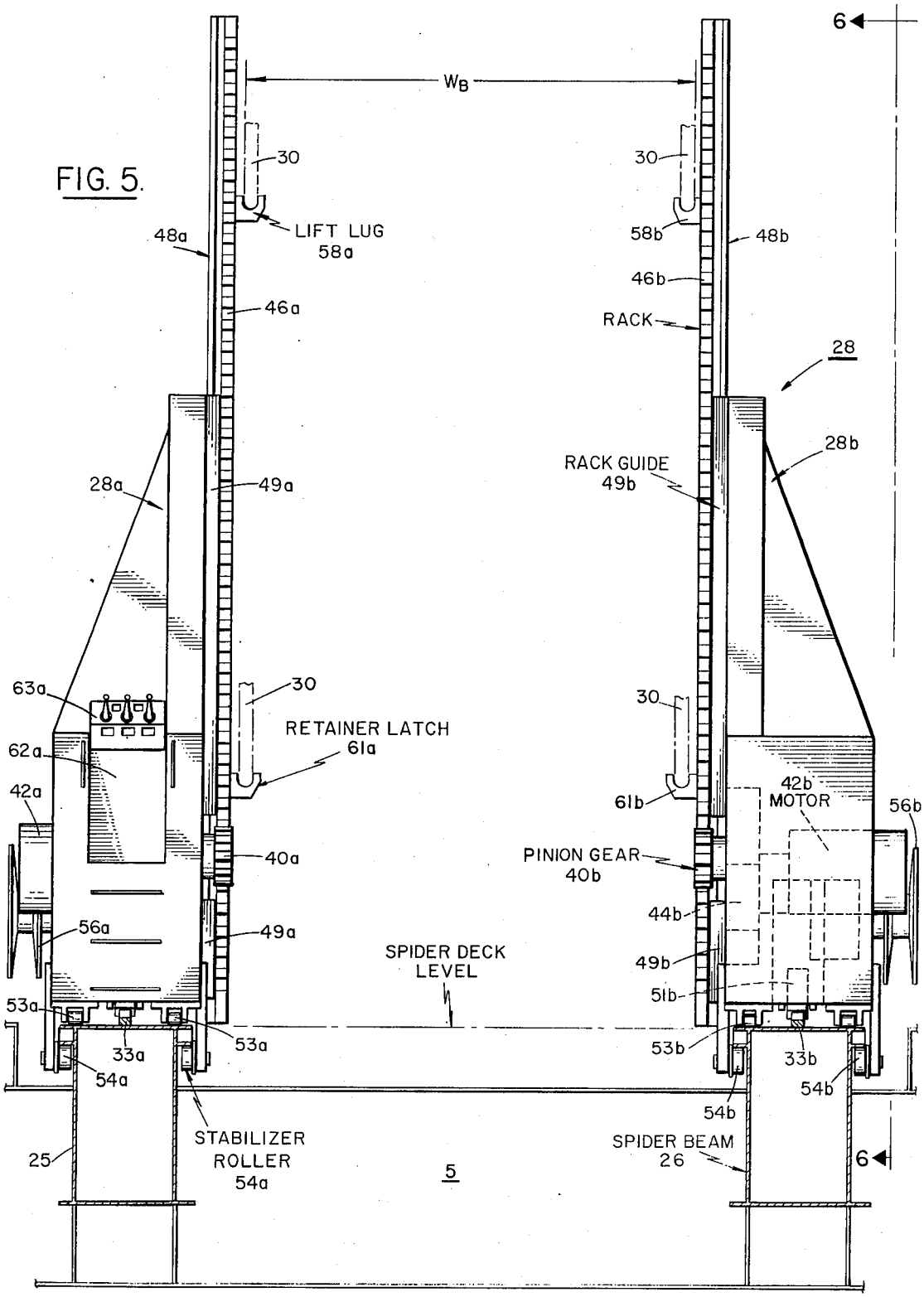
FIG. 5 is a front view of the transporter system.

In operation, to move the blowout preventer stack 30 from position A to position C (FIG. 3), the lift lugs 58*b* and 58*a*, of the racks 48*b* and 48*a*, are operated to engage each side of the upper portion of stack 30. The retainer latches 61*b* and 61*a* are also operated to engage each side of the lower portion of the stack 30. As shown in FIG. 5, $W_B$ represents the maximum width of the blowout preventer which can be accommodated with the illustrated spider beam spacing. The connector 32 on the lower end of stack 30 is released from test stump 31 and the stack is raised clear of the test stump by actuation of motors 40*b*, 41*b*, 40*a* and 41*a* to cause racks 48*b* and 48*a* to move vertically upward. The stack is moved to approximately the height $H_1$. The frame drive motors 52*b* and 52*a* are then energized to drive pinion gears 51*b* and 51*a* which engage the racks 33*b* and 33*a*, respectively, on spider beams 26 and 25 and move frame 28 and BOP stack 30 are moved to any position on spider beams 26 and 25.

The racks 48*b*, 48*a* and blowout preventer stack 30 are then lowered by actuation of motors 40*b*, 41*b*, 40*a* and 41*a* to cause racks 48*b* and 48*a* to move vertically downward so that the top of the stack will clear overhead obstacles, such as cross beam 34 of the derrick substructure 20, during movement from position B to position C. When in position C the stack 30 may be moved to any desired vertical position, within the rack design limits. When in position C, guide cables are aligned through guide tubes on the stack 30 and conventional means are connected to the stack for lowering the stack for connection by connector 32, to the upper end of the well pipe adjacent the ocean floor. Once the lowering means is securely connected to the stack the operator can then operate the lift lugs 58*a*, 58*b* and retainer latches 61*a* and 61*b* to release them from engagement with the stack 30. The frame 28 is then operated to move on spider beams 25 and 26 and returns to the original position A.

Figure 10:
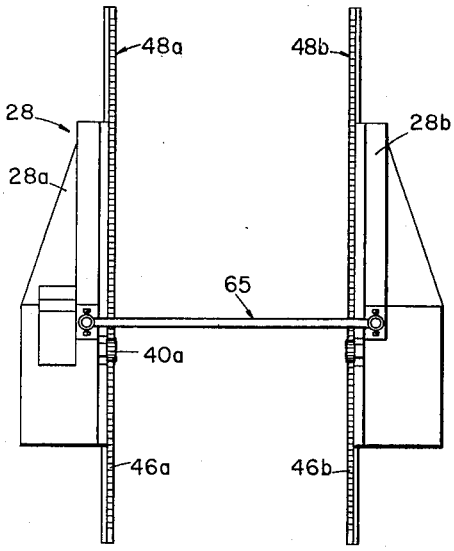
FIG. 10 is a view taken along lines 10—10 of FIG. 9.
Figure 9:
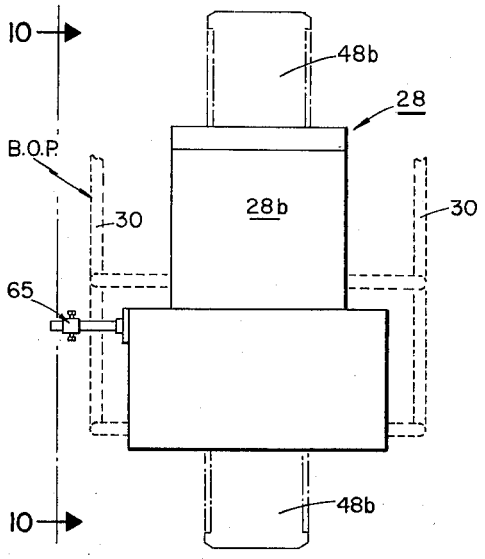
FIG. 9 is a side view of a modified transporter frame.

Referring now to FIGS. 9 and 10, it may be desirable to connect frame sides 28*a* and 28*b* by a linking member such as 65 to ensure that the frame sides move together synchronously. The linking device may be adjustable as shown so as to accommodate the width of the stack 30 as shown. As shown in FIG. 3, a frame housing, indicated at 70, may be provided to protect frame 28 and stack 30 when in storage.

Changes and modifications may be made in the specific, illustrative, embodiments of the invention shown and/or described herein without departing from the scope of the invention as defined in the appended claims.

Having fully described the method, apparatus, objects and advantages of my invention I claim:

1. An equipment handling system for use on floating drilling vessels comprising: two parallel extending tracks arranged on said drilling vessel;

a rack arranged on each of said tracks;

a frame supported on each of said tracks, said frame having two sides; a gear arranged on each of said frame sides engageable with said rack associated with such side;

a vertically extending rack arranged on each of said frame sides;

a pinion gear arranged on each of said frame sides engageable with said vertically extending rack associated with such side;

means connected to each of said frame sides for moving said frames along said tracks;

motor means on each of said frame sides for driving said pinion gear associated with such side and for powering said means for moving said frame sides along said tracks;

lifting means arranged on each of said frame sides engageable with equipment to be transported by said frame sides; and an equipment retainer latch arranged on each of said vertical racks and movable therewith.

2. A system as recited in claim 1 in which stabilizer roller means are arranged on each of said frame sides and are engageable with said track associated with such side for stabilizing said frame sides.

3. A system as recited in claim 2 including guide means for guiding said vertically extending racks.

4. A system as recited in claim 3 including means connecting said two frame sides together.

5. A system as recited in claim 4 in which said vessel is a semisubmersible vessel and said equipment is a blowout preventer stack.

6. An equipment handling system for use on floating drilling vessels comprising:

first and second parallel extending tracks arranged on said drilling vessel;

a first rack arranged on said first track;

a second rack arranged on said second track;

a frame supported on said tracks having first and second sides;

a first gear arranged on said first frame side engageable with said first track;

a second gear arranged on said second frame side engageable with said second track;

a first vertically extending rack means arranged on said first frame side;

a second vertically extending rack means arranged on said second frame side;

a third gear arranged on said first frame side engageable with said first vertically extending rack means;

a fourth gear arranged on said second frame side engageable with said second vertically extending rack means;

first motor means arranged on said first frame side for driving said first and third gears for moving said first frame side along said first track and for moving said first vertically extending rack means up and down;

second motor means on said second frame side for driving said second and fourth gears for moving said second frame side along said second track and for moving said second vertically extending rack means up and down;

first lifting means arranged on said first vertically extending rack means and movable therewith engageable with said equipment to be transported by said frame;

a first equipment retainer latch arranged on said first vertically extending rack means, and movable therewith; and a second equipment retainer latch arranged on said second vertically extending rack means and movable therewith.

7. A system as recited in claim 6 including first stabilizer roller means arranged on said first frame side and engageable with said first track for stabilizing said first frame side; and second stabilizer roller means arranged on said second frame side and engageable with said second track for stabilizing said second frame side.

8. A system as recited in claim 7 including first guide means for guiding said first vertically extending rack means; and second guide means for guiding said second vertically extending rack means.

9. A system as recited in claim 8 in which said first and second vertically extending rack means each comprise two spaced apart racks.

10. A system as recited in claim 9 including means connecting said two frame sides together.

11. A system as recited in claim 10 in which said vessel is a semisubmersible vessel and said equipment is a blowout preventer stack.

12. An equipment handling system for moving equipment on a floating drilling vessel, said vessel containing a drilling platform having a main deck and a lower deck provided with an opening located below said main deck comprising:

a drilling derrick supported on said main deck;

two parallel extending tracks arranged on said lower deck on each side of said lower deck opening;

means arranged on said lower deck for storage, maintenance and/or testing of said equipment, said two parallel extending tracks extending to said storage, maintenance and/or testing means;

a rack arranged on each of said tracks;

a frame having two sides and supported on said tracks;

first gear means arranged on each frame side and engageable with said rack associated with such frame side;

a vertically extending rack arranged on each frame side;

second gear means arranged on each frame side engageable with said vertically extending rack associated with such frame side;

means on each of said frame sides for driving said first and second gear means to move said frame sides along said track and to move said vertically extending racks;

lifting means arranged on each of said frame sides engageable with said equipment to be transported by said frame sides; and equipment retainer latch means arranged on said vertical racks and movable therewith.

13. An equipment handling system for moving equipment on a floating drilling vessel, said vessel containing a drilling platform having a deck provided with an opening comprising:

two parallel extending tracks arranged on said deck on each side of said deck opening;

means on said deck for storage, maintenance and/or testing of said equipment, said two parallel tracks extending to said storage, maintenance and/or testing means;

a rack arranged on each of said tracks;

a frame having two sides and supported on said tracks;

a first gear means arranged on each frame side and engageable with said rack associated with such frame side;

a vertically extending rack arranged on each frame side;

second gear means arranged on each frame side engageable with said vertically extending rack associated with such frame side;

means on each of said frame sides for driving said first and second gear means to move said frame sides along said track and to move said vertically extending racks;

lifting means arranged on each of said frame sides engageable with said equipment to be transported by said frame sides; and equipment retainer latch means arranged on said vertical racks and moveable therewith.

* * * * *